US005497699A

United States Patent [19]

Mather

[11] Patent Number: 5,497,699

[45] Date of Patent: Mar. 12, 1996

[54] METHOD OF SILK SCREEN PRINTING ON A ROUGH SURFACE SUCH AS A FOOTBALL

[76] Inventor: Clifford L. Mather, 10865 Jennifer La., Boca Raton, Fla. 33428

[21] Appl. No.: 346,073

[22] Filed: Nov. 29, 1994

[51] Int. Cl.[6] ..... B41M 1/12

[52] U.S. Cl. ..... 101/129; 101/114; 101/128.4; 101/32; 101/483

[58] Field of Search ..... 101/114, 128.4, 101/129, 4, 32, 33, 34, 35, 483, 487, 490, 491, 494

[56] References Cited

U.S. PATENT DOCUMENTS 5,174,204 12/1992 Meier et al. ..... 101/129

5,395,414 3/1995 Matasick et al. ..... 101/129

*Primary Examiner*—Edgar S. Burr
*Assistant Examiner*—Lynn D. Hendrickson
*Attorney, Agent, or Firm*—Malin, Haley, DiMaggio & Crosby

[57] ABSTRACT

A method for applying and reproducing an original visual image such as an oil painting or photograph onto a rough vinyl or leather surface using silk screen ink techniques for a high resolution permanent image transformation, especially useful on objects having a course or roughened surface, such as a football, basketball, or the like, wherein an image is applied to a rough surface by an improved silk screening type method resulting in a sports ball having a multi-colored reproduction of the image on the ball exterior.

9 Claims, No Drawings

METHOD OF SILK SCREEN PRINTING ON A ROUGH SURFACE SUCH AS A FOOTBALL

BACKGROUND OF THE INVENTION

1. Field of the Invention

This invention relates to a method for silk screen printing on an expanded vinyl or leather surface, especially a rough surface, such as found on a football or basketball, for applying high quality reproduction of an oil painting, photograph, or corporate logo, and especially sports images. Specifically, this invention is directed to a method, and the product produced thereby, of silk screen printing on the vinyl surface of a football, to form a decorative design or reproduction, which has high resolution and cannot be easily removed or affected during assembly or inflation.

2. Description of the Prior Art

The use of silk screen technology for providing reproductions of artwork and photographic representations on various surfaces is well known. Fabric is often decorated using silk screen techniques. Although fabric surfaces are quite amenable to silk screen techniques, certain other surfaces, based on their composition, hardness, texture, smoothness and other factors, have not been used. Specifically, material having a rough surface with recessed portions is particularly difficult on which to apply silk screen designs since traditional ink formulations and application methods do not adequately coat the recessed areas thereby degrading the quality of the reproduction. Furthermore, past attempts at applying multi-colored images to material used to make sports balls resulted in cracking or flaking of the image during the assembly process in which the ball is turned inside out prior to final assembly or during inflation when the surface experiences slight expansion.

In the current sports world, memorabilia containing images of players, team designs, team logos especially for baseball, football and basketball, and trading cards, has become a large industry in itself.

The present invention relates to the reproduction of sport images including players, designs and logos which may be based on an oil painting or photograph, or other works, such that a reproduction of the image is transferred onto a vinyl surface of a sporting object such as a football. In the specific embodiment shown in this invention, the applicant has invented a method to provide a high quality image on the surface of a football, or a portion thereof, that has a vinyl or leather surface using silk screen techniques.

The method is also usable for other sport objects such as basketballs or other vinyl, leather, or other synthetic type materials such that the image remains unaffected by the turning experienced during assembly or inflation.

SUMMARY OF THE INVENTION

A method for applying and reproducing an original visual image such as an oil painting or photograph onto a vinyl or leather surface using silk screen ink techniques for a high resolution permanent image transformation, especially useful on objects having a coarse Dr roughened surface, such as a football. The original image is optically scanned into a computer wherein image dots which comprise the image are adjusted for color enhancement and color adjustment from which computer generated films are made. The surface of the specific vinyl based material (such as the surface of a football) must be initially prepared with an acetone type solvent to open the pores of the vinyl material (hereafter referred to as the work-piece). The work-piece is then wiped with a light pressure and the excess solvent is removed. The work-piece is then air dried individually for a predetermined length of time. After air drying, the work-piece may be re-cured for a given time at a given temperature. The work-piece is cut with edges marked for control registration. After cutting the material is seasoned for 12 to 14 hours, meaning the material is allowed to dry, to allow the removal of excess moisture from the work-piece material, in a controlled environment prior to any printing process.

For the silk screen process, a series of flexible, stretchable ink formulations are selected as to types, mixtures, viscosity and reducers, for use with a high mesh count silk screen. The high mesh count silk screen cannot be used with conventional inks so different ink formulations are required for the proper results. The present invention contemplates the use of both vinyl and ultra-violet ink using both process colors and colors matched using the Pantone Matching System. The mesh is mounted in a frame under high tension. A different silk screen mesh is used for each color.

The enhanced image is transferred to each silk screen by light exposure on photo-sensitive emulsions on the silk screen.

The silk screen material is selected with mesh count being of prime importance. The silk screen material is stretched and chemically prepared with the proper chemicals relative to the proofs. Each silk screen is then prepared with the proper lighting and time exposure, including post cure screen and blockout. Each silk screen gets 250 hits before production. The screen exposure is controlled by color, by area, flash background, light and proper exposure. The silk screen frames are critical to obtain high tension of the silk screen mesh material.

The work-piece is positioned under one silk screen and the silk screen ink is applied using an ink squeegee having a certain durometer value and sharpness. Once the ink image has been transferred onto the vinyl work-piece surface (that will ultimately be formed into a football) the ink transferred image is cured at a certain temperature for a predetermined amount of time. There is an additional subsequent air curing time after which the material may be further die cut for its ultimate use as a football.

The work-piece is then hand powdered to act as a dry lubricant which allows the work-piece to be stitched together with other cooperating pieces and formed into a football by applying heat and turning the work-piece inside out without affecting the image.

It is an object of this invention to provide an improved method for providing high quality artwork using silk screen ink techniques to a vinyl based surface such as a football.

It is another object of this invention to provide an improved method of silk screening that allows for a permanent high quality reproduction artwork mounted on a vinyl based surface for use in sporting objects such as: footballs and basketballs.

And yet still another object of this invention is to allow the use of objects such as footballs or basketballs to receive a permanent art form for use as memorabilia.

A further object of the instant invention is to provide a method whereby materials having rough surfaces may be prepared and decorated with a high quality multi-colored reproduction of an image using high mesh count/high tension silk screen techniques and specific vinyl or ultra-violet sensitive ink formulations.

Still another object of the present invention is to provide a method of printing whereby an image is applied onto a work-piece as to allow turning of the material containing the image such that the image does not crack or flake.

DESCRIPTION OF THE PREFERRED EMBODIMENTS

This would be the preferred embodiment of the invention. A football for having artwork mounted on a portion of its surface is selected as a sports object. The original artwork, which has already been created by an artist, such as an oil painting of a pro football quarterback or an action photograph of a pro football quarterback, or other sports image, is selected for transfer. The original artwork is photo-processed, or reproduced, into a transparency, which is then scanned into a computer for storage and which allows the computer to make adjustments for color, dots, line screen 120 to 150, angle of screening and number of images. Adjustments to the scanned image are made using image processing software that may incorporate the random dot method of image modification for enhancing image quality. Once the final image is selected on the computer a film positive emulsion up is then produced for each color of the process colors used in silk screen process, such as magenta, yellow, black and cyan. One film, typically a positive, is created for each color. Films are then test shot onto test screens with a set exposure to light using photo-setting emulsions such that portions of the screen are masked by each film. The image is then test printed on a surface to proof the film's colors and screen exposure. Adjustments are made to screens such as angular placement on screen, and amount of light exposure for each color. In addition the ink formulations are adjusted and reformulated as necessary. Some areas may receive two to four different exposures within the same color using masking films to achieve the desired results. The design is proofed again to test film's exposure and color. These steps may be repeated in order to achieve the highest quality reproduction of the original artwork.

The vinyl or leather material, such as material used in footballs or basketballs or the like, requires surface preparation including: wiping with a solvent with light pressure; air drying the material individually; curing the material at a predetermined temperature for a predetermined amount of time; cutting the material; and obtaining squared stock with edges marked for controlled registration. The material is then air seasoned for twelve to fourteen hours, in a controlled environment prior to printing, to allow the removal of excess moisture. The material is typically seasoned in an air conditioned environment at room temperature (approximately 72–78 degrees Fahrenheit and 50% relative humidity).

Also prior to the actual silk screen process, various ink formulations must be arrived at. Vinyl ink is used and must have a predetermined mixture viscosity and reducer based on the mesh size of the silk screen of at least one color. In an alternate embodiment, ultra-violet sensitive inks are used such that ink applied to the material's surface may be cured using ultra-violet radiation. The ink is mixed for various process colors and colors determined using a matching system.

A. PREPARATION OF SILK SCREENS

The silk screen, halving a mesh count of between 305 and 510, is set up in a highly tensioned and stretched configuration in a diamond chase frame. Once the inks are selected and prepared, the screen receives one color ink which is transferred by the printing process in which the screen contacts the work-piece and the ink is transferred by a squeegee-like action through the silk screen with controlled squeegee pressure. The high mesh count screen and use of vinyl ink optimize surface coverage by allowing the ink to penetrate into the recessed areas of the surface. The screen itself is stretched, with a predetermined amount of tension, and chemically prepared. In addition, the screen is exposed by light exposure for a predetermined time exposure of 100 to 850 light units. The screen is also post-cured with sunlight or ultraviolet light. The mesh of the screen is prepared using a reducer blockout over special areas.

After the print is made with a special squeegee the work-piece having images is then cured at an elevated temperature for a predetermined amount of time. It is further air cured for a predetermined amount of time. Finally, the work-piece is hand powdered to act as a dry lubricant which allows the die cut work-piece to be turned inside out. For example, when creating a football, the work-pieces are stitched together and heat is applied to soften the vinyl or leather material for turning. The lubricating powder is selected to be cornstarch free.

Example. The work-piece is prepared by wiping a synthetic vinyl material, that will be used to make a football, with light pressure using a solvent. The work-piece is dried 3 to 6 hours. The work-piece is also cured at 180 degrees F. for two minutes.

The material is cut in squared stock with edges marked for controlled registration.

The work-piece is then seasoned for 12 to 14 hours at conditioned room temperature, approximately 72 degrees Fahrenheit and 50% relative humidity, prior to printing to allow the removal of excess moisture.

B. PREPARATION OF INKS

The ink formulations are selected and a vinyl ink is used with four basic process colors, yellow, magenta, cyan and black. In addition to process colors, colors may be formulated using the Pantone Matching System. Colors are mixed into various percentages using half tone base and clear extended base. Pressure is a critical factor in the printing process in that too little pressure will not print all the dots through any image which causes voids in that particular color, and too much pressure will make the dots grow or become larger which causes a loss of definition in the design. The combination of silk screen mesh count, ink formulation, and squeegee pressure taught in this invention results in high quality, high definition, image reproduction on rough surfaces.

The silk screen is selected with a monofilament or polyester mesh, using a diamond chase frame with the mesh count between 305 and 510. The silk screen is stretched with a tension between 18 and 32 newtons. In order to create the screen, the time exposure of light between 100 and 850 light units is used. A Halide light source lamp using a programmable integrator is used to measure the time exposure. The screen must be cured with sunlight or ultraviolet light. The mesh is prepared with a reducer.

During the actual print process a squeegee is selected having a durometer reading between 60 and 90 and of a predetermined sharpness. Once the work-piece receives the printed image it is cured at a predetermined temperature for a predetermined amount of time. The work-piece is then air cured for a predetermined amount of time. It is further die cut to get it ready to be sewn together as a football. When stitched together, the partially assembled ball exists inside out (i.e. the stitching is on the outside while the multicolored image is on the inside). Therefore, it is necessary to turn the ball inside out, as is required by the ball making process, without damaging the silk screen reproduction. Thus, a cornstarch-free powder is applied by hand to act as a dry lukricant, and heat is applied to soften and allow the ball to be turned inside out without affecting the image. Finally the balls are stitched together resulting in a completed ball, such as a football, with the stitching in the interior and a multi-colored image reproduction on the exterior surface.

APPENDIX (FLOWCHART)

producing a color transparency of an image by photographic reproduction digitizing the image by scanning the transparency into a computer memory enhancing the digitized image using image processing software generating a film positive of the image for each process color and each matched color, including magenta, yellow, black, and cyan photo-chemically producing high mesh count silk screen stencils, by mounting suitable silk screen material in individual diamond chase frames such that each of the stencils is tensioned within a frame by a force of between 18 and 32 newtons, masking each stencil with an emulsion treated film positive and exposing the silk screen material to between 100 and 850 light units of ultra-violet radiation, and curing with low intensity ultra-violet radiation, resulting in silk screen stencils each having a mesh count between 305 and 510, for each color preparing a work-piece having a rough surface, such as vinyl or leather material used to make a sports ball, by applying a solvent drying the work-piece for 3 to 6 hours at ambient conditions curing the work-piece at 180 degrees for approximately two minutes preparing vinyl ink formulations for each process color and each matched color including magenta, yellow, black, and cyan, including mixtures of half-tone base and clear extended base loading a silk screen printing machine with one of the vinyl ink formulations and one of said diamond chase frames having a silk screen stencil mounted therein seasoning the work-pieces for 12 to 14 hours test printing an image utilizing said silk screen stencils improving print quality and color reproduction, by reformulating the inks, adjusting silk screen angular placement, ultra-violet exposure, including the use of masking films, to achieve the highest quality reproduction of the original image reproducing said image by applying the selected vinyl ink formulation by forcing the ink through the silk screen stencil with a squeegee having a durometer reading between 60 and 90 and a pre-determined sharpness, such that said vinyl ink formulation coats both raised and recessed portions of the surface repeating the vinyl ink application procedure for each color and silk screen stencil combination thereby resulting in a multi-colored reproduction of the image on the work-piece surface curing the work-piece for a predetermined time at room temperature cutting the work-piece material into desired geometric configurations and marking the cut work-pieces for reference curing the work-piece at 180 degrees for approximately two minutes applying a cornstarch free powder to the work-piece surface containing the multi-colored image for functioning as a lubricant stitching the work-piece together with other cooperating pieces to form a sports ball heating the work-piece to soften the material thereby allowing the sports ball to be turned inside out without affecting the applied image adding final stitching resulting in a finished sports ball having a rough exterior surface with a multi-colored reproduction of the image thereon

What is claimed is:

1. A method of silk screen printing on a rough surface, such as found on a football, for applying a high quality reproduction of a sports image including the steps of:

digitizing an image by scanning the image into a computer memory;

enhancing the digitized image using image processing software;

generating a film positive of the image for each process color and matched color, including magenta, yellow, black, and cyan;

photo-chemically producing high mesh count silk screen stencils for each color, each stencil having a mesh count between 305 and 510, by mounting said silk screen stencils in individual diamond chase frames such that each of the stencils is tensioned within a frame by a force of between 18 and 32 newtons, using photo-setting emulsions exposed to a light source;

preparing at least one work-piece having a rough surface, including vinyl and leather material used to make a sports ball, by applying a solvent;

drying the work-piece for at least 3 hours at ambient conditions;

preparing ink formulations suitable for use with high mesh count silk screen stencils for each process color and matched color including magenta, yellow, black, and cyan, using mixtures of half-tone base and clear base;

loading a silk screen printing machine with one of the prepared ink formulations and one of said diamond chase frames having a silk screen stencil mounted therein;

seasoning the cut work-pieces for at least 12 hours prior to printing;

reproducing said image by applying a selected ink formulation by forcing the ink through the silk screen stencil with a squeegee having a durometer reading between 60 and 90 and a pre-determined sharpness, at a controlled pressure such that said ink formulation coats both raised and recessed portions of the work-piece surface;

repeating the ink application procedure for each color and silk screen stencil combination thereby resulting in a multi-colored reproduction of the image on the work-piece surface;

curing the work-piece in ambient conditions;

trimming the work-piece to a desired geometric configuration and marking the trimmed work-piece for reference;

curing the trimmed work-piece at 180 degrees for at least one minute;

applying a cornstarch free powder to the work-piece surface containing the multi-colored image for functioning as a lubricant;

stitching the work-piece together with other cooperating pieces to form a sports ball;

heating the material to soften, thereby allowing the sports ball to be turned inside out without affecting the applied image such that the stitching along the seams is positioned on the ball interior and the multi-colored image is positioned on the ball exterior, resulting in a finished sports ball having a rough exterior surface with a multi-colored reproduction of the image thereon such that the image is unaffected by turning or inflation.

2. A method of silk screen printing on a rough surface, such as found on a football, for applying a high quality reproduction of a sports image according to claim 1, wherein said work-piece comprises expanded vinyl material.

3. A method of silk screen printing on a rough surface, such as found on a football, for applying a high quality reproduction of a sports image according to claim 1, wherein said work-piece comprises leather material.

4. A method of silk screen printing on a rough surface, such as found on a football, for applying a high quality reproduction of a sports image according to claim 1, wherein said image processing software enhances image quality by using a random dot enhancement method.

5. A method of silk screen printing on a rough surface, such as found on a football, for applying a high quality reproduction of a sports image according to claim 1, wherein said ink is vinyl based.

6. A method of silk screen printing on a rough surface, such as found on a football, for applying a high quality reproduction of a sports image according to claim 1, wherein said ink comprises ultra-violet ink that is cured using ultra-violet radiation.

7. A method of silk screen printing on a rough surface, such as found on a football, for applying a high quality reproduction of a sports image including the steps of:

producing a color transparency of an image by photographic reproduction;

digitizing the image by scanning the transparency into a computer memory;

enhancing the digitized image using image processing software;

generating a film positive of the image for each process color and matched color, including magenta, yellow, black, and cyan;

photo-chemically producing silk screen stencils, by treating the silk screen material with a photo-setting emulsion, masking the silk screen material with a film positive and exposing the silk screen material to between 100 and 850 light units of ultra-violet radiation, and curing with low intensity ultra-violet radiation, resulting in silk screen stencils each having a mesh count between 305 and 510, for each color;

mounting said silk screen stencils in individual diamond chase frames such that each of the stencils is stretched within a frame by a force of between 22 to 32 newtons;

preparing vinyl ink formulations for each process color and each matched color including magenta, yellow, black, and cyan, using formulations including mixtures of half-tone base and clear extended base;

test printing an image utilizing said silk screen stencils;

improving print quality and color reproduction, by adjusting silk screen angular placement, ultra-violet exposure including the use of masking films, and reformulating inks to achieve the highest quality reproduction of the original image;

preparing a work-piece having a rough surface, such as vinyl or leather material used to make a sports ball, by applying a solvent;

drying the work-piece for 3 to 6 hours at ambient conditions;

curing the work-piece at 180 degrees for approximately two minutes;

cutting the work-piece material into desired geometric configurations and marking the cut work-pieces for reference;

seasoning the cut work-pieces for 12 to 14 hours at room temperature;

loading a silk screen printing machine with one of said vinyl ink formulations and one of said diamond chase frames having a silk screen stencil mounted therein;

reproducing said image by applying selected vinyl ink formulations by forcing the ink through the silk screen stencil with a squeegee having a durometer reading between 60 and 90 and a pre-determined sharpness, such that said vinyl ink formulation coats both raised and recessed portions of the surface;

repeating the vinyl ink application procedure for each color and silk screen stencil combination thereby resulting in a four color process reproduction of the image on the work-piece surface;

curing the work-piece in ambient conditions;

applying a cornstarch free powder to the work-piece surface containing the multi-colored image for functioning as a lubricant;

trimming the work-piece and stitching the work-piece together with other cooperating pieces to form a sports ball;

heating the material to soften, thereby allowing the sports ball to be turned inside out without affecting the applied image resulting in a finished sports ball having a rough exterior surface with a four color reproduction of the image thereon such that image quality is unaffected.

8. A method of silk screen printing on a rough surface, such as found on a football, for applying a high quality reproduction of a sports image according to claim 7, wherein said work-pieces comprise expanded vinyl material.

9. A method of silk screen printing on a rough surface, such as found on a football, for applying a high quality reproduction of a sports image according to claim 7, wherein said work-pieces comprise leather material.

* * * * *